United States Patent [19]

Stevens

[11] Patent Number: 4,502,407

[45] Date of Patent: Mar. 5, 1985

[54] METHOD AND APPARATUS FOR CLEANING, VIEWING AND DOCUMENTING THE CONDITION OF WELDMENTS ON OFFSHORE PLATFORMS

[75] Inventor: James W. Stevens, Houston, Tex.

[73] Assignee: Shell Oil Company, Houston, Tex.

[21] Appl. No.: 367,488

[22] Filed: Apr. 12, 1982

[51] Int. Cl.[3] ..... B63G 8/00

[52] U.S. Cl. ..... 114/222; 294/66.2

[58] Field of Search ..... 114/222, 312, 322, 321, 114/330, 338; 294/66 A; 405/185; 414/1; 354/112, 113; 352/131, 132

[56] References Cited

U.S. PATENT DOCUMENTS 2,795,173 6/1957 Bates ..... 354/112

3,550,386 12/1970 Ballinger ..... 114/337

3,922,991 12/1975 Woods ..... 114/222

OTHER PUBLICATIONS

Eric II (Cable Controlled Deep Submergence Teleoperator System), Mechanism and Machine Theory, 1977, vol. 12, pp. 481–492 by J. Charles.

*Primary Examiner*—Trygve M. Blix

*Assistant Examiner*—Edwin L. Swinehart

[57] ABSTRACT

A subsea platform inspection vehicle on a power tether cable adapted to be propelled through the water and lock onto an underwater member of a platform adjacent a welded joint and provided with a jet to clean a weld and a television camera to observe the condition of the weld.

4 Claims, 11 Drawing Figures

FIG. 2
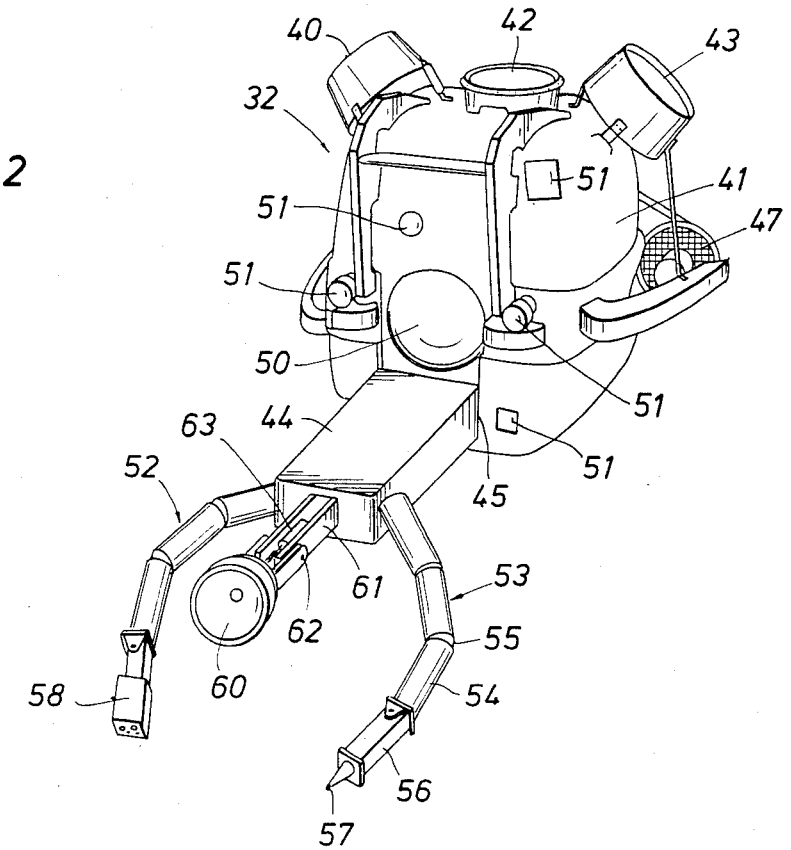
FIG. 11
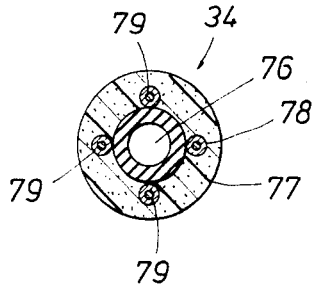
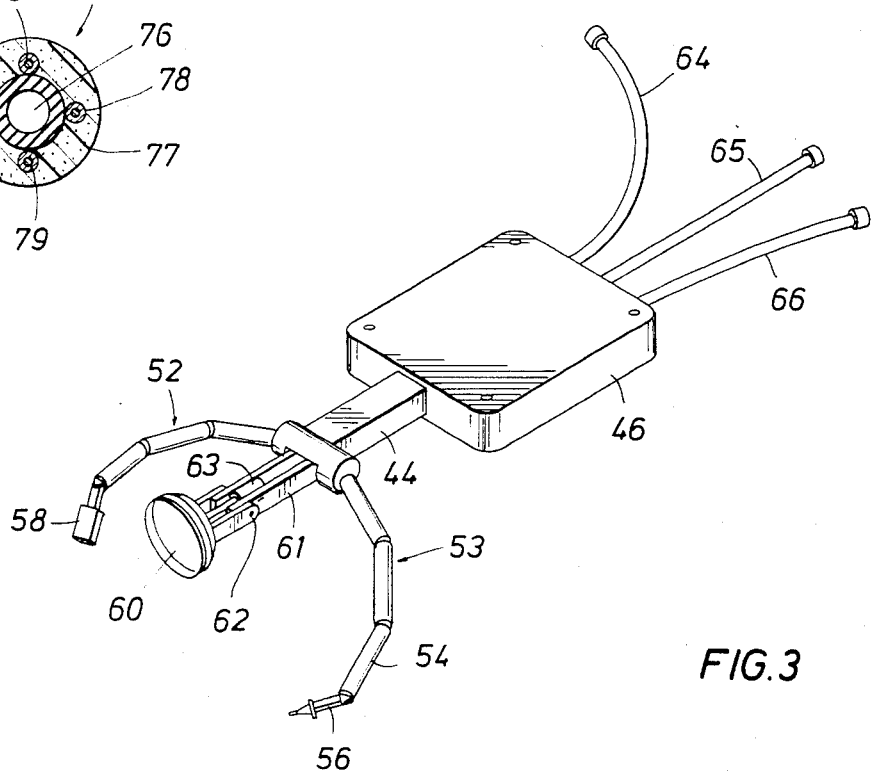
FIG. 3

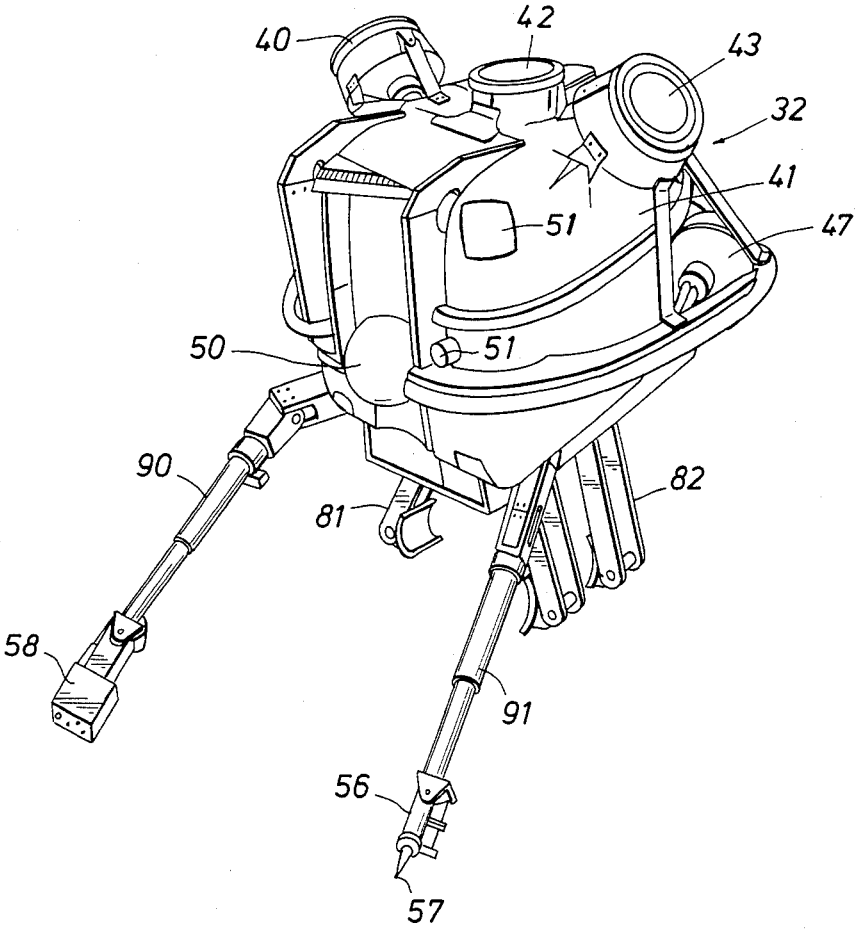
FIG. 6
FIG. 7
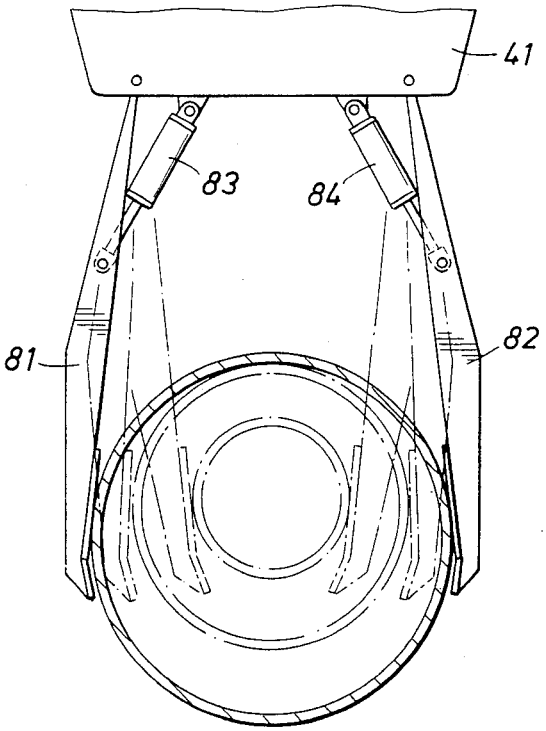
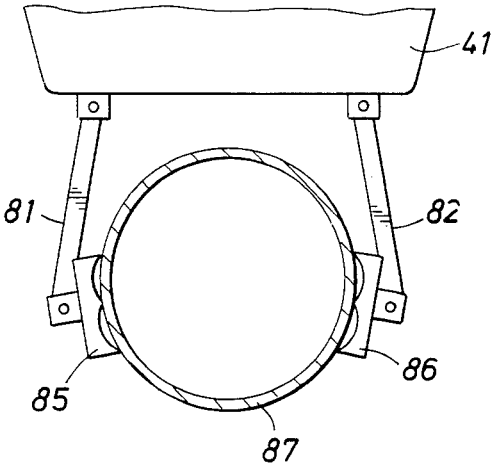
FIG. 8

METHOD AND APPARATUS FOR CLEANING, VIEWING AND DOCUMENTING THE CONDITION OF WELDMENTS ON OFFSHORE PLATFORMS

BACKGROUND OF THE INVENTION

This invention relates to a method and apparatus for cleaning, viewing, inspecting, and documenting the condition of underwater weldments employed at the junction of the various structural members of an offshore platform, particularly a deepwater platform on which said operations are not possible by the normal use of divers.

Present day offshore platforms used in the oil and gas industry are often formed of large diameter pipe elements in the form of three or more vertical or slanting legs interconnected or reinforced by cross-bracing tubular members. Such bottom-supported platforms have been used in waters as deep as 1025 feet. For example, one deepwater platform in the Gulf of Mexico in 1025 feet of water has eight legs that are made of 78 inch diameter pipe through which 72 inch diameter pipe piles were used. Between 2 and 3,000 cross-bracing members were used in the structure and since each member was welded at least twice to another member, this resulted in up to 6,000 weldments being formed in the platform. In addition, the platform is provided with over sixty 24-inch diameter vertical well conductors that are grouped near the center of the platform and through which individual wells are drilled. Further, there is secured to the platform a plurality of vertical pipe risers through which oil and gas may be separately pumped down to the ocean floor pipeline and thence to shore.

From a safety and operational standpoint, it is desirable to know the condition of the various weldments in the platform structure and to keep a record of them. Thus, it is desirable to periodically inspect the weldments and photograph them in order to keep a record of any corrosion that may be taking place or to know when one of the welded joints has cracked.

It is well known to employ remotely-controlled underwater vehicles operations at the end of a tether to observe and carry out operations on underwater structures such, for example, as an underwater wellhead as described in U.S. Pat. No. 3,099,316 and related U.S. Pat. Nos. 3,163,221-3,165,899 and 3,463,226. These patents are all directed to the use of a remotely-controlled underwater vehicle for use with an ocean floor wellhead. Underwater wellheads and pipelines located on the ocean floor have free space around them so that they may be approached easily by any type of a submarine or underwater vehicle without encountering any structure that would prevent their underwater television camera from viewing the structure of interest.

However, it is a different matter to use a tethered underwater vehicle that is remotely operated and move it around, over and between the various cross-bracing members of an underwater structure so as to clean, observe, and photograph in detail the thousands of welds in the structure. It is generally necessary to use a remotely-controlled underwater vehicle of small size so as to be able to move into areas of limited access. In addition, it is necessary to employ flexible or articulated arms on the underwater vehicle in order to be positioned in close proximity to some of the welds being studied, such, for example, as the welds around a diagonal brace at the point it meets horizontal and vertical members.

SUMMARY OF THE INVENTION

It is an object of the present invention to provide a method and apparatus for cleaning and photographing the condition of the welds at each end of the hundreds or thousands of members of a deep water structure such as an offshore platform used in oil and gas drilling. Use is made of a remotely-controlled underwater vehicle of any suitable type well known to the art, preferably one that is small in size so that it can maneuver within the maze of vertical and cross-bracing members of a platform. Use is made of a television-equipped self-propelled underwater vehicle equipped with thrusters adapted to be powered and operated, with operations and underwater environment around the vehicle being observed visually at the surface for selectively controlling the operation of the vehicle which is connected to the surface location by a power- and signal-transmitting cable.

The underwater vehicle is provided with flexible arms carrying cleaning, viewing, and/or photographing equipment from the surface location down through the body of water to a preselected position within the underwater framework of the platform. The underwater vehicle is secured or temporarily anchored to the underwater structure in close proximity to the weldment to be cleaned and studied so that the cleaning tool carried by the underwater vehicle can be positioned close, say, one inch, from the weldment to be cleaned. In a like manner, the photographing and/or television camera means carried by the other flexible arm are adapted to be positioned close to the weldment being cleaned and studied. However, the camera equipment is arranged to be positioned to view cleaning operations at an angle to the axis of the jet stream of the cleaning apparatus.

The two arms of the underwater vehicle are adaptations of existing manipulator technology. The viewing and documentation arm may use individual rate controls for each of its 5 degrees of freedom. The cleaning arm, which may require more dexterity and precise positioning, may be designed as a spatially corresponding manipulator with a surface master on the work vessel which is used to control the position and movement of the vehicle-mounted slave arm. Since it is desired to take photographs of welds, or any other corroded areas, the viewing arm is provided with suitable cameras which may be a monocular system but is preferably a stereoscopic camera system, with a close-focus monocular capability, which may be utilized for the optimum photographic documentation of welded joints. The binocular stereoscopic camera gives a much better perspective of pitting or corrosion depth for use by the structural engineer reviewing the photograph. Additionally, the viewing arm is provided with a second television camera so as to observe cleaning operations at close range. The optical or viewing head incorporated on the articulated viewing arm of the vehicle is made as small as possible to provide the proximity and angular perception required for the extraction of useful information about the observed weldment.

BRIEF DESCRIPTION OF THE DRAWING

These and other objects and advantages of this invention will become apparent from the description that follows hereinafter and the drawing which forms a part hereof, in which;

FIG. 2 is a isometric view showing one form of the underwater vehicle contemplated by the present invention.

FIG. 3 is an isometric view of the tool body or package of FIG. 1.

FIG. 6 is an isometric view of another form of the underwater vehicle having a different arrangement of the anchoring means as well as the articulated arms.

FIG. 7 is a diagramic view of one form of an anchoring device carried by the underwater vehicle.

FIG. 8 is another form of an anchoring device carried by the underwater vehicle.

FIG. 11 is a view taken in cross-section of one form of a tether cable for use in transmitting electric and hydraulic power to the underwater vehicle while transmitting signals therefrom to the surface station.

DESCRIPTION OF A PREFERRED EMBODIMENT

Figure 1:
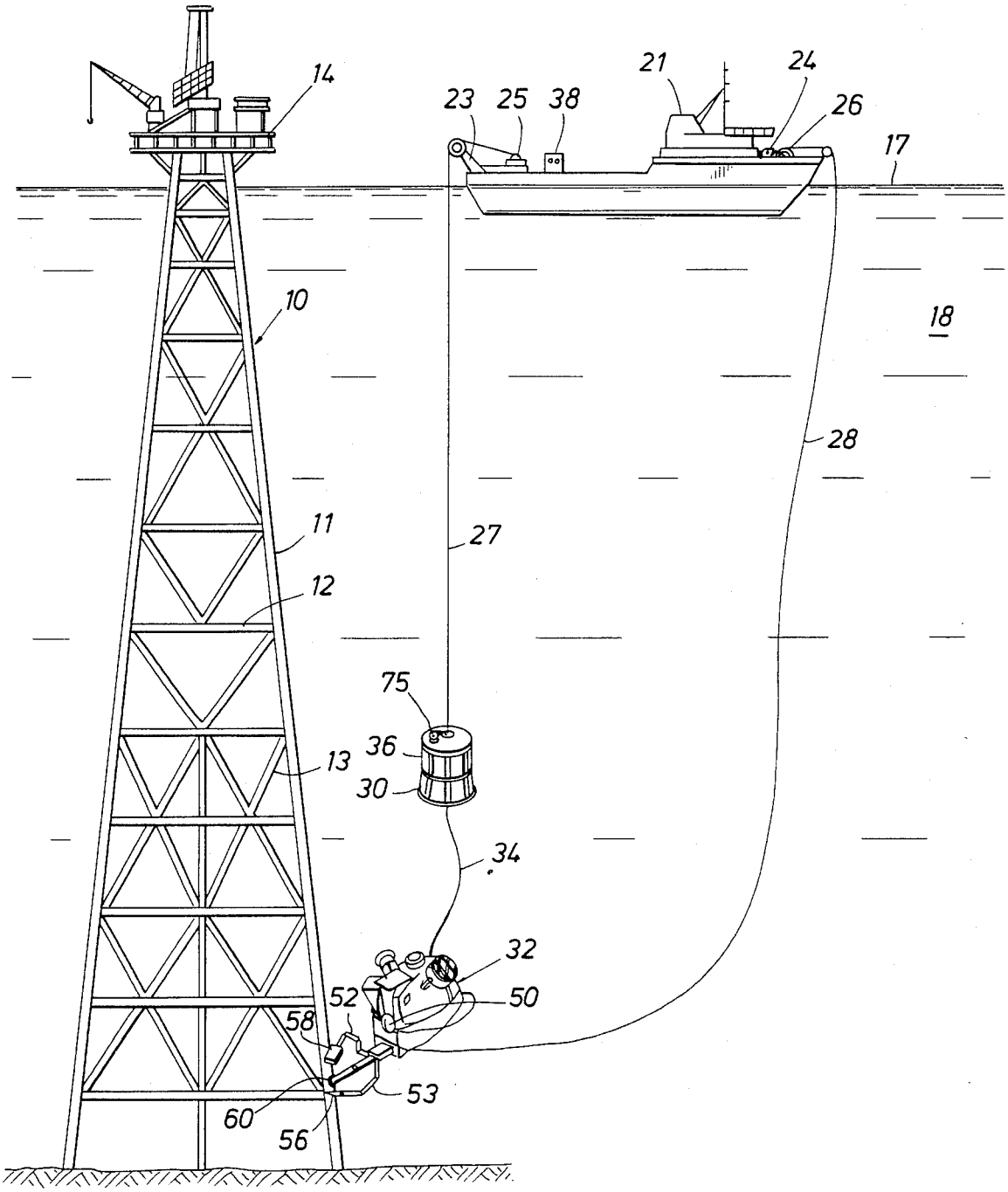
FIG. 1 is a schematic view illustrating an underwater platform substructure alongside which is anchored an operating vessel for lowering a remotely-controlled underwater vehicle to a position on or within the structure.

Referring to FIG. 1 of the drawing, an offshore platform 10 is shown as comprising a plurality of slanting legs 11, cross-bracing members 12 and diagonal braces 13. The platform 10 is also provided with a deck 14 on which is mounted the various pieces of equipment that are used in the production of oil and gas wells. Positioned on the surface 17 of the body of water 18 is a surface boat 21 positioned in any suitable manner near the platform 10 on which the operations are to be carried out. The service boat 21 is also provided with a winch 26 on which may be spooled a hose 28 or a cable structure incorporating a hose for providing fluid under pressure from a pump 24 on board the vessel 21 to the remotely-controlled underwater vehicle 32.

The remotely-controlled underwater vehicle 32 is connected to its protective lowering or launch cage 30 by means of a tether 34. A remotely operable reel or drum 36 is mounted in the upper portion of the cage 30 and is adapted to be remotely operated through cable 27 from the service boat 21 to reel in or let out the tether 34, as required. Since vehicle launching cages 30 are well known to the art and form no part of this invention, they will not be further described here.

Hoisting cable 27 is a load-supporting cable as well as being equipped to transmit power from the vessel 21 to the vehicle 32, and to pass signals up and down the cable to operate the equipment carried by the vehicle 32 as well as to operate the tether reel 36 carried by the cage 30. In a like manner, the tether cable 34 is both a power- and signal-transmitting cable which preferably is of neutral buoyancy to reduce the drag on the vehicle 32 as it moves through the water. Power to the vehicle 32 and signals to and from the vehicle are conducted through cables 27 and 34. A controller means 38 is located on the vessel 21 for controlling the functions of the vehicle 32 as well as its cage 30. The controller 38 is also equipped with a television screen for viewing the area in the vicinity of the vehicle 32.

Remotely-controlled underwater vehicle systems are well known to the art and are manufactured by several companies such as Perry Oceanographics, Inc. of Riviera Beach, Fla., and also Hydro Products of San Diego, Calif. An early design of an underwater vehicle for operation around a submerged oil well installation is described in U.S. Pat. No. 3,099,316 while accessories for such an underwater vehicle are described in U.S. Pat. Nos. 3,163,221, 3,165,899, and 3,463,226.

All of these vehicles are designed to operate from the end of a tether cable and are provided with suitable propulsion means for moving the vehicle in any direction, an operating arm for carrying out an operation under water, and television means connected to a viewing screen at the surface for viewing the operations carried out by the vehicle.

Figure 9:
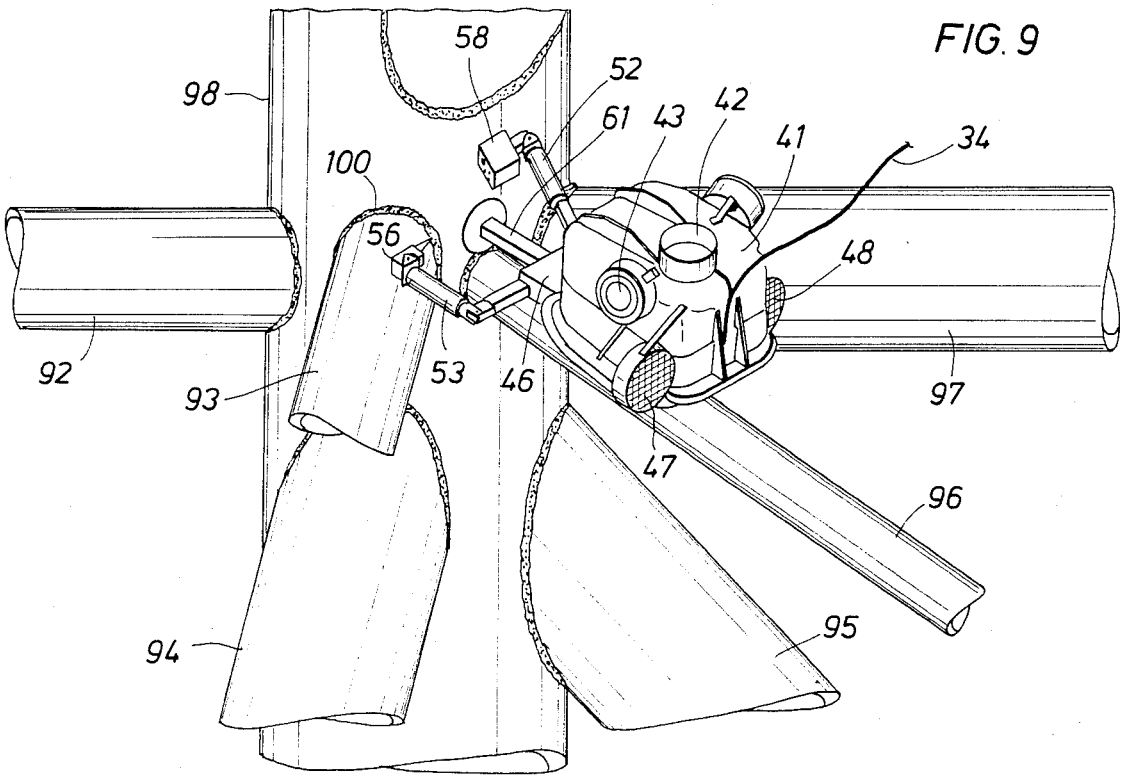
FIGS. 9 and 10 are schematic views showing the underwater vehicle of the present invention positioned at two different locations on the structural supports of an underwater platform.
Figure 10:
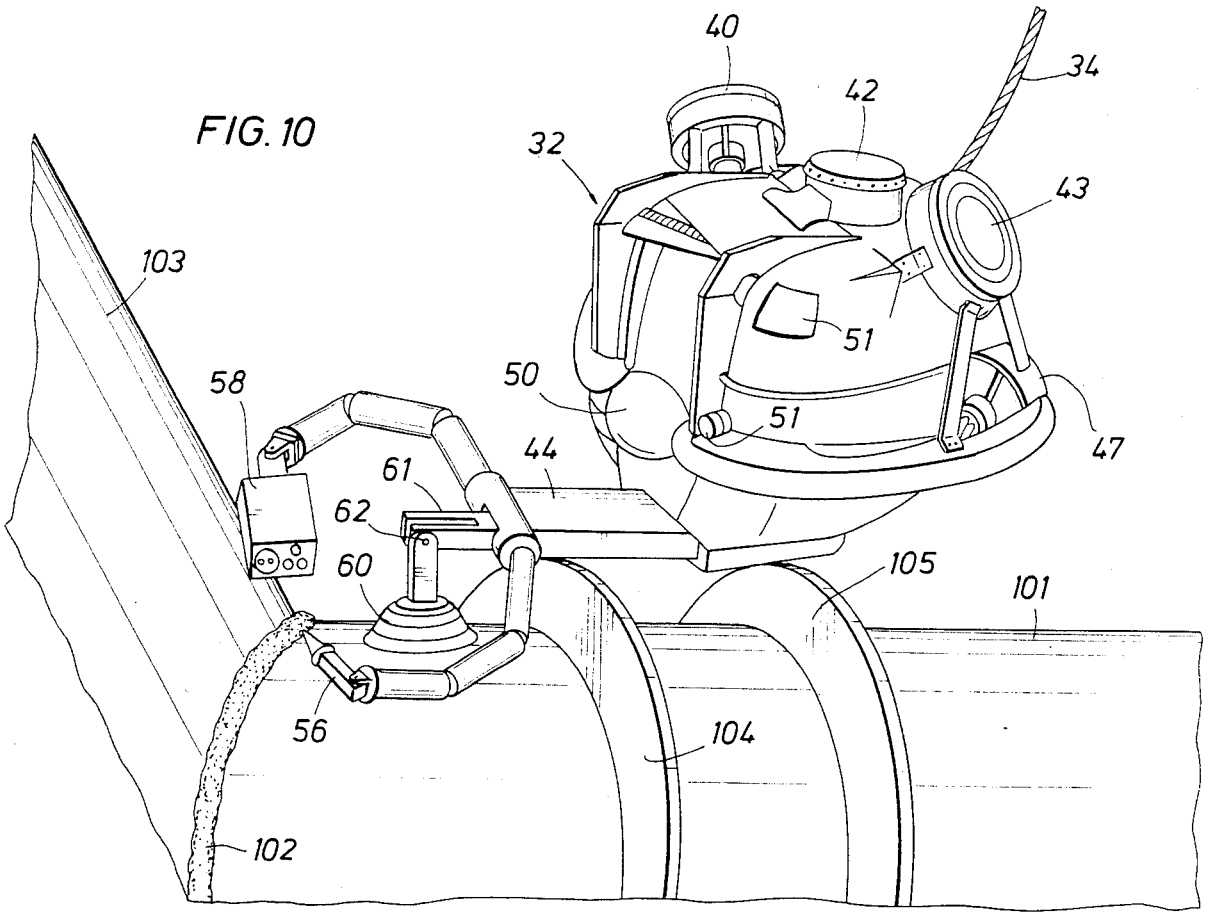

One form of a remotely-controlled underwater vehicle 32 is shown in greater detail in FIGS. 2, 9, and 10. The vehicle 32 comprises a housing which may be opened or closed or may consist of the combination of both. In FIG. 2, a closed housing 41 is shown in which there is mounted a control module, say, for example, below numeral 42 for receiving signals from an operator at the surface location so as to operate the equipment carried by the vehicle. Preferably, centrally positioned and vertically or substantially upwardly-downwardly directed on housing 41 are motor-driven thrusters or propulsion units 43 and 40 adapted to discharge in either axial direction. The major portion of the closed housing section 41 is filled with a buoyant material in an amount sufficient to give a preferably slightly positive buoyance to the vehicle 32. It is desired that the vehicle have a slight positive buoyancy so that in the event of loss of power through the tether 34, the vehicle would float to the surface of the body of water. Also carried by the vehicle housing 41 are horizontal thrusters 47 and 48 of any type well known to the art. These thrusters 47 and 48 permit movement of the vehicle horizontally fore and aft or can be used to rotate the vehicle.

A television unit is carried at one end of the vehicle which will normally be designated as the forward end of the vehicle. The television system comprises a television camera 50 together with one or more suitable lights 51. The television camera 50 may be mounted on and adapted to be moved in any direction by a pan and tilt mechanism in a manner well known to the art. The television assembly is connected to the control module 42 and thence through tether cable 34 and hoisting cable 27 to the controller 38 on board the vessel 21.

Referring to FIG. 2 of the drawing, the body 41 of the vehicle is shown as being provided with a tool body 44 which is preferably located on the lower portion of the vehicle body 41 below the television camera 50. The tool body 44 is preferably adapted to the hydraulically powered to extend from a recess 45 in the front of the vehicle body 41 near the bottom thereof. Fixedly secured to the tool body near the front end thereof are a pair of flexible articulated work arms 52 and 53. The arms 52 and 53 are made up of a plurality of sections 54 hinged together, as at 55, with the last section of each arm being considered a terminal section.

In the case of one arm 53, known as a cleaning arm, the terminal section of the arm comprises a hinged cleaning tool 56 having a discharge nozzle 57. The other arm 52 may be termed a viewing or observation arm and has a terminal section containing camera means 58 which will be described in greater detail hereinbelow.

The tool body 44 is also provided with vehicle anchoring apparatus in the form of a suction cup 60 mounted at the end of an extendible arm 61 which may be rotatable and hinged, as at 62, and actuated by hydraulic cylinder 63.

In FIG. 3, the apparatus of the present invention is shown as comprising a control console 46 adapted to be fixedly secured and carried on the bottom of the vehicle 41 of FIG. 2. The auxiliary control console 46 is provided with conduits 64, 65 and 66 which are connected to similar conduits within the vehicle 41 to provide hydraulic power and cleaning fluid to the cleaning arm 53 and cleaning tool 56. At the same time, hydraulic pressure fluid would be supplied through one of the conduits 64, 65 or 66 to actuate the arms 52 and 53 and the extendible arm 61 of the anchoring means 60 if these arms are hydraulically actuated. On the other hand, in the event that arms 52 and 53 and anchoring arm 61 are electrically actuated, current and signals would be provided through one or more of the conduit means 64, 65 or 66 to the auxiliary control console 46 and thence to the arms being operated.

Figure 4:
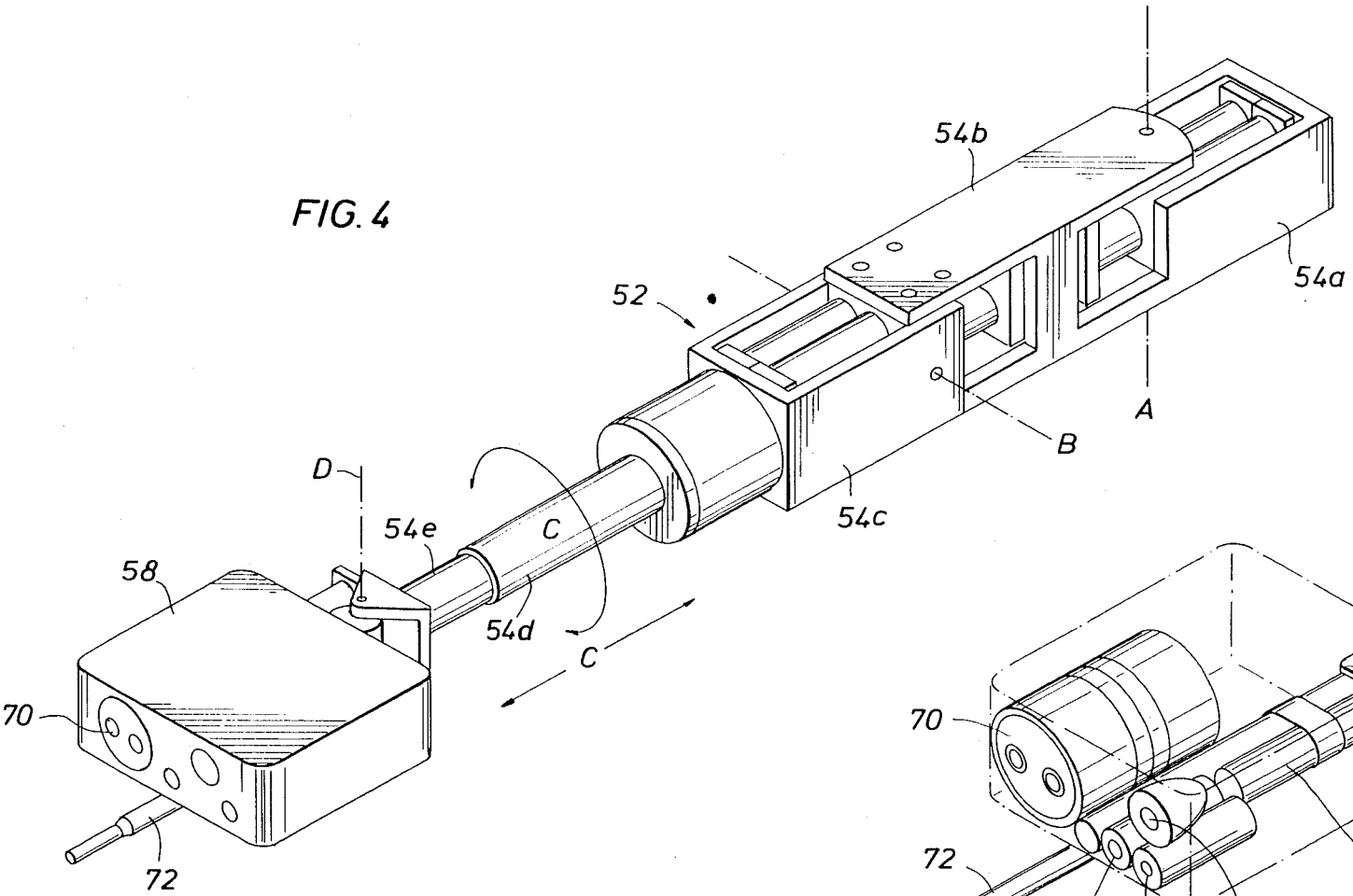
FIG. 4 is an isometric view of one form of a viewing arm of the present underwater vehicle.
Figure 5:
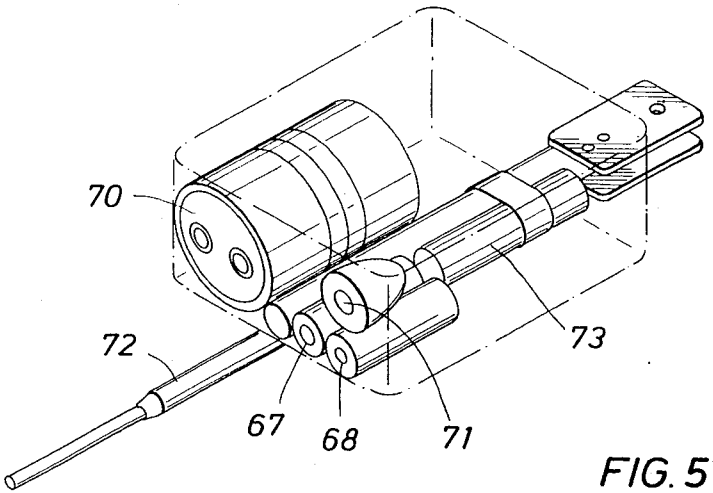
FIG. 5 is a schematic view showing the components of the camera package carried at the end of the viewing arm of FIG. 4.

Another form of a viewing arm 52 is illustrated in FIG. 4 and is shown as comprising arm segments 54*a*, 54*b*, 54*c*, 54*d*, and 54*e*. The arm 52 is designed to have a rotation of 270 degrees around axis capital A, a rotation of 180 degrees around axis B, with a rotation of 180 degrees around C and a 90 degree rotation about axis D. In addition, arm elements 54*d* and 54*e* have a 12-inch extension relative to each other. Thus it may be seen that the camera unit 58 carried at the end of arm 52 in FIG. 4 had five degrees of freedom so as to be directed to any object selected at an underwater location. The camera unit 58 carried at the end of arm 52 as shown in FIGS. 4 and 5 comprises a television camera 67 and its light 68 that is needed to illuminate the area of an object being cleaned as the television camera 50 carried by the vehicle 41 (FIG. 2) is not adequate for close work. In addition, the camera unit 58 is provided with a camera 70, in this case a stereoscopic camera and its flash unit or strobe light 71. If desired, the camera unit may be provided with its own battery pack.

It is an object of the present invention to be able to look at a nodal welded area by television as well as to obtain high quality color still photographs of the welded area. Typically, the television camera 50 (FIG. 2) utilized by most types of underwater vehicles is mounted on the forward part of the vehicle body, for both navigation and inspection applications. However, during cleaning operations this camera 50 is about four feet from any weld of interest and thus does not permit the required close-in detailed viewing desirable for weld inspection application. It is desirable to get in as close as practical with the television camera in order to discern detail on the welded area. This distance may be as close as 6 inches depending on the television optics used but is generally in the range of one to two feet during cleaning operations. The vehicle's fixed television camera 50 contributes little to actual weld inspection application but is desirable for monitoring the overall operation due to its standoff distance. In particular, it can give the tool operator a better perspective as to where the cleaning tool 56 (FIG. 2) is positioned with respect to other known vehicle or platform appendages. The thrusters may be used as needed to clear away floating debris from the area of interest in front of the camera.

It is necessary to position a television camera in a manner so as to allow the operator of the cleaning device to position and update the cleaning tool 56 effectively. Since underwater monochromatic television does not provide accurate depth perception, it may be very difficult for the operator to position accurately the cleaning tool at a specified distance from the weld to be cleaned. With a fine television camera precisely behind the cleaning tool, it is virtually impossible for the tool operator to determine the distance of the tool from the weld. However, if the camera unit 58 is positioned at a 45-degree angle with respect to both the weld and the cleaning tool 56, then it becomes possible to determine more accurately the height and position of the tool with respect to the weld since components of a two-dimension geometric view are visible.

This depth perception consideration is also applied to actual weld inspection. In order to determine the depth and extent of weld pitting and corrosion, the viewing system, and, in particular, the lighting therefor, are placed at some angle with respect to the corrosion, so that the shadows generated by the viewing geometry may be observed. The shadows allow relative determination of the depth and the extent of the corrosion. Thus, by employing an auxiliary and independent television camera mounted at the end of flexible arm 52, the operator at the surface controller 38 can adjust the camera unit 58 at an angle to the weld and to the cleaning tool. Also, using a small independent auxiliary television camera 67 in the camera unit 58, it is possible to place the camera unit within 6 inches of the intersection of two members of an underwater structure that intersect and are welded to each other at a 30-degree angle.

Underwater cameras, both monocular and stereoscopic, are well known to the industry. Although the camera 70 (FIG. 5) may be a monocular system, it is preferred to use a binocular stereoscopic camera in order to obtain a better perspective of the pitting and corrosion depth on a photograph which will be studied by a structural engineer. It is preferred to use a stereoscopic camera system having in addition a close-focus monocular capability in order to obtain the optimum photographic documentation of the welded joints cleaned by the apparatus of the present invention. A high intensity light such as a strobe light 71 is preferred and the light should be set to one side of the camera 70. Rather than attempt to adjust the focus of the camera from the surface or attempt to estimate by means of the television camera 50 the distance the auxiliary camera 67 was with respect to the weld being photographed, it is preferred that the still camera 70 having a fixed-focus to some distance setting be provided with a prod 72 being carried by the camera unit 58. The prod 72 would be adjustable to the same length as the focusing distance of the camera 70. The prod 72 (FIGS. 4 and 5) is mounted on the camera unit 58 and is preferably extendible and retractable by means of an actuator 73. When it is desired to photograph the weld, the prod would be extended a selected distance ahead of the camera. The camera arm 52 would then be moved until the prod 72 was in contact with the area to be photographed thus bringing the camera into focus with it. Photographs would then be taken.

By using a telescoping prod 72, it is possible to allow the camera unit to move as close to a weld as needed during the cleaning operations. The telescopic prod is preferably provided having an immediate length setting and a fully extended setting of, say, 29 inches in length for stereoscopic photography. The intermediate minimum camera focus length would be for close-in photography. In either case, the prod may or may not be physically visible in the photograph. However, since the diameter of the prod is about one-half inch, the prod does not distract from or obscure the photograph of the weld. In general, the existance of the end of the prod 72 in a photograph and the knowledge that it is a half-inch wide, gives a measuring device against whioh the length or width of pits or corrosion may be compared. Thus, the prod serves as a measuring device and may even be inserted into a pit to give some indication of its depth.

Referring to FIG. 1 of the drawing, the vehicle 32 is shown as being anchored by means of suction cup 60 to an area of the platform 10 which is to be cleaned and inspected. The cleaning tool 56 at the end of the cleaning arm 53, is provided with seawater from a pump (not shown) carried within the vehicle 32, the intake of the pump being open to seawater. Alternatively, a pump 75 may be mounted in or on top of the vehicle launching cage 36 with the outlet of the pump being in communication through tether cord 34, vehicle 32, and cleaning arm 53 with the jetting tool 56. The benefits enjoyed from positioning the pump 75 on the cage 36 are mainly due to the fact tha the weight of the pump, instead of being carried by the vehicle 32, is carried by the cage 36 which is suspended from weight-supporting cable 27.

In another form of the invention, the pump 24 and the prime mover means for driving the pump may be positioned on the surface ship 21 with the pump 24 being connected to the cleaning arm 53 through the vehicle 32 by means of an independent hose 28. The use of hose 28 would be in addition to the power- and signal-transmitting tether cable 34. One form of a tether cable 34 is shown in FIG. 11 as being made up of a ¼-inch, 10,000 psi working pressure hose 76 being surrounded by a buoyant jacket 77 of any suitable material well known to the art which would give a substantial neutral buoyancy to the tether cable. Embedded within the jacket material is a coax cable 78 and three electrical conductors 79. Thus, by use of a cable of this type, cleaning fluid under pressure can be supplied to the cleaning tool 56, power can be supplied to the vehicle and its various accessories, signals can be transmitted from the controller 38 on the surface vessel 21 to the underwater vehicle 32 and television signals can be received on board the vessel from the camera unit 58 carried by the camera arm 52 and from the vehicle 32 to camera 50.

The jetting tool 56 carried at the end of the cleaning arm 53 may be of the normal type used at the end of a high pressure hose used for water blasting of debris or marine growth around offshore platforms. While this type of a cleaning head 56 can be used in some cases, a cavitation type of tool is preferably employed. A tool of this type utilizes cavitation erosion in the removal of marine fouling, calcareous growth, corrosion products and other materials from an underwater structure. In order to obtain a satisfactory survey of the surface or the welds of an underwater platform, it is necessary to clean the structure down to the bare metal. Cavitation, the formation and collapse of vapor-filled cavities or bubbles, is the result of flow-induced pressure reductions in a fluid. A cavitation-producing nozzle or orifice will accelerate the flow and decrease the pressure below the vapor pressure of water. This creates cavitation bubbles which are entrained in the flow. As the stream of bubbles nears the work surface being cleaned, the pressure gradients increase and the bubbles begin to deform and collapse creating localized high stress.

A cavitation type cleaning tool requires high water pressures and adequate water flowrates to perform the cleaning operation. A cavitation type cleaning head performs the cleaning task by two distinct mechanisms. A water current flow is physically generated by the tool which causes an impingement action to dislodge lately attached marine growth. This action is typically effective at tool ranges of approxiately one foot and is identical to normal water blasting techniques. The second and more effective mechanism of cleaning is the generation of millions of small diameter bubbles filled with water vapor at a very low pressure in the ocean immediately around the tool nozzle.

The generation of these bubbles in the ocean by a cavitation nozzle is accomplished by jetting a high pressure head of water through a small orifice at a prescribed flow rate. Due to the relative low pressure area of the high velocity jet stream after it exits from the nozzle, seawater molecules change from the liquid phase to the vapor phase, creating millions of small diameter bubbles whose interior is occupied by water vapor at pressures approaching 0 psia. Consequently, a stream of cavitation bubbles occurs near the nozzle orifice (within several inches) where the jet stream velocity is the highest and the absolute pressure is the lowest. When marine growth (or other material on the structure) is suddenly exposed to this stream of cavitation bubbles, the marine growth or other material is violently sheared from the underwater structure due to the collapse of the bubbles. Thus, marine growth is effectively removed. As the cavitation bubbles collapse, an implosion takes place which causes an extreme local stress in the immediate region of collapse. These high local stresses act upon the surface of the marine structure and erode away marine growth.

If the distance between the jet and the work surface is properly maintained, the collapse of the cavitation bubbles (which occurs just beyond the nozzle orifice) aids in the removal of tenacious growth and corrosion products. Generally, if fan jet nozzles are used the optimum standoff range for cavitation has been found to be from 12 to 100 times the nozzle orifice size, or ½ to 1½ inches. The width of area cleaned with each pass of the cleaning tool over the work surface is dependent upon the nozzle design. Although under equivalent operating conditions the peak intensity of a straight nozzle exceeds that of a fan jet nozzle, fan jets have been found to clean an area up to 10 times greater than typical straight jets. According to research conducted by Daedalean Associates, Inc., the orifice diameter that has proved to be most effective in removing marine fouling is the ASTM standard orifice design of 0.031 inch diameter. In a test it was found that this nozzle developed a peak intensity of cavitation erosion of more than 3807 Btu/hr $ft^2$. For marine fouling it was found that it was necessary to expend 143 Btu/hr $ft^2$ of energy to erode one type of marine growth from a work surface.

A big advantage of using a cavitation tool is that there is very little reaction force generated by the jetting water stream therefrom compared to a normal water blasting jet tool. Thus, there is little likelihood of the vehicle 32 being moved from its anchored position on the underwater structure by the reaction force of the cleaning tool. Tests have shown that the best cleaning action from cavitation nozzles is accomplished when the axis of the tool nozzle is held at an angle of from about 30 degrees to 60 degrees with respect to an imaginary line taken normal to the weld or work surface.

Referring to FIG. 2 of the drawing, the anchoring means for the vehicle 32 are shown as comprising a suction cup 60 connected through arm 61 and tool body 44 to the vehicle body 41. If desired, the suction cup 60 may be connected directly to the tool body 44. A suction pump (not shown) contained within the vehicle body 41 or the tool body 44 is operatively connected to the suction cup 60 evacuating it after it has been placed against a selective anchoring place on the underwater structure. In carrying out the anchoring operation, with the cleaning arm 54 and the viewing arm 52 in a retracted position, the thrusters on the vehicle are actuated to drive the vehicle forward and place the suction cut against the anchoring surface. The suction pump within the vehicle is then energized to evacuate the suction cup 60 and hold the vehicle in a fixed position. Since the vehicle is substantially neutrally buoyant, there is little tendency other than water currents to pull the vehicle away from its anchored position.

Suction cups such as that illustrated at 60 (FIG. 2) may be pushed by the vehicle against a work surface with the thrusters being used to position the vehicle in the water. Thus the main function of the suction cup 60 in such a case would be to prevent slippage along or away from the anchoring point. Suction cups have been developed which have sponge-like outer edges which conform and are adapted to be used on a fairly rough surface. Also, suction cups may be used even though there is some leakage around the edges of the cup. Cups are believed to be superior to electromagnetic anchoring devices, which may be used in some circumstances, as suction cups do not discriminate between metallic and non-metallic structures. Therefore, they can be used to secure to concrete pilings. Additionally, a suction cup does not produce a large magnetic field which might interfere with the operation of the television camera carried by the vehicle. In addition, a suction cup anchoring device is generally substantially lighter in weight than an electromagnet, thus reducing the load on the vehicle.

Another form of the invention is shown in FIGS. 6, 7 and 8 wherein the underwater vehicle 32 is provided with ridged arms 81 and 82 that are adapted to be actuated by hydraulic cylinders 83 and 84 (FIG. 7) by controls within the vehicle body 41. In FIG. 7, the arms 81 and 82 are shown in phantom as being adapted to secure the vehicle body 41 to pipe of varying diameters. In FIG. 8, the arms 81 and 82 of the anchoring device are provided with pivoted clamping shoes 85 and 86 at the ends thereof which are adapted to conform to and bite into the outer wall of the pipe 87. While rigid arm clamping or anchoring means illustrated in FIGS. 6, 7 and 8 may be used on small diameter pipe, they are not suitable anchoring means for an underwater vehicle working on underwater platforms having structural members up to 80 inches in diameter. Clamping arm anchoring means of a size that could anchor the vehicle to a 70 or 80-inch diameter pipe would add substantial weight to the underwater vehicle and exhibit increased drag on the vehicle in maneuvering through the water.

The underwater vehicle shown in FIG. 6 differs from that shown in FIG. 2 in that the vehicle of FIG. 6 is provided with a viewing arm 90 and a cleaning arm 91 which are separately connected to the vehicle body 41 on the lower portion thereof and on either side of the housing body 41 so that there is substantial spacing between the arms which are 90 and 91. The viewing arm 90 is substantially identical to that shown in FIG. 4. The cleaning arm 91 is of similar construction with a cleaning head 56 and a cavitation nozzle 57 carried as the outer most segment of the arm.

The apparatus of the present invention may be used for carrying out a method of cleaning, observing, inspecting, and photographing selected areas of an underwater structure, such as the substructure of an offshore platform. In particular, the present apparatus was designed to check platform members for corrosion and to inspect and photograph the welds between various members that are interconnected to form the substructure. For example, in FIG. 9 a plurality of pipes or tubular members 92, 93, 94, 95, 96 and 97 are shown as being welded to a main tubular element 98. In this figure, the underwater vehicle body 41 is shown as being positioned by means of a suction cup 60 at the end of arm 61 which is connected to the vehicle body 41 through tool body 46. The cavitation cleaning tool 56 is illustrated as being observed through the television unit of the camera head 58 while the cleaning tool cleans away the marine growith, corrosion products, and/or any other material from the weld. In the event that it was not possible to seat the suction cup 60 in an anchoring position on vertical pipe member 98 (FIG. 9) due to a substantial accumulation of marine growth, the operator on the surface vessel 21 (FIG. 1) at the controller 38 would have caused the cleaning arm 53 and its tool 56 to clean a portion of the outer surface of the tubular member 98 in an area large enough to seat the suction cup 60 in a substantially fluid-tight manner. Periodically, as a section of the weld 100 is cleaned by the jetting fluid from the cleaning tool 56, photographs are taken from the camera housing 58, preferably with a stereoscopic camera.

Referring to FIG. 1, it may be seen that all underwater operations may be carried out with a television-equipped self-propelled underwater vehicle equipped with thrusters and anchoring means and adapted to be powered and operated with operations and underwater environment being observed visually at the surface by an operator who selectively controls the operations by transmitting signals through a power- and signal-transmitting cable.

When the surface vessel 21 arrives at location, the underwater vehicle 32 is carried within or next to the bottom of the cage 30 which is then lowered by winch 25 on weight supporting cable 27 substantially to the depth at which the vehicle is to operate on or within the underwater platform substructure. The vehicle 32 is then released from its cage 30 and receives operating signals and power through tether cable 34. The area of interest on the underwater structure is located by means of the television camera 50 on the vehicle 32. The operator on the surface then selects an anchoring point on the underwater structure which is adjacent the area of interest. The vehicle 32 has been anchored at the anchoring point which, if necessary, may be cleaned by jetting water from the cleaning arm of the vehicle. With the vehicle anchored on the structure, its cleaning arm is then moved and swept across the area of interest, for example, a weld between two elements of the structure. The cleaning arm during this operation is normally held at an angle to the surface of the object being cleaned. In a like manner, the viewing arm of the vehicle is moved to a location at an angle different from that assumed by the cleaning tool so as to view the cleaning operation from a different angle.

After the weld or other area of interest on the platform has been cleaned, a record of any corrosion which has occurred may be obtained by taking a photograph of that area or weld with the stereoscopic camera which is positioned a selective distance from the area being photographed. The cleaning and viewing arms of the vehicle are than moved as the cleaning and viewing and photographing operations are continued within the area of reach of the arms of the vehicle. Subsequently, the anchoring means 60 are released and the vehicle is moved by its thrusters to another position where it is re-anchored and the operation starts over again.

In FIG. 10, the underwater apparatus 32 of the present invention is illustrated as being anchored to a pipe 101 for cleaning and photographing a weld 102 between pipes 101 and 103. In this case, pipe 101 is provided with a pair of ring or pipe stiffeners which are flange-like in design. Thus, in order to anchor the vehicle 32 to the pipe 101, it is necessary to first tilt the suction cup 60 on its hinge 62 to a position 90 degrees from its arm 61. This illustrates the flexibility of this type of anchoring device. After operation have been concluded on the platform 10, the vehicle 32 swims back to its cage 30 through operation of its thrusters while the tether 34 is being reeled up on the reel 36 at the top of the cage. With the vehicle secured within or to the bottom of the cage 30, it is hoisted to the surface vessel 21 by the winch 25.

What is claimed is:

1. An underwater vehicle adapted to be operated from a remote location above the surface of a body of water through a power- and signal-transmitting tether cable, said vehicle being adapted to be propelled through said water to an underwater steel structure to clean and inspect welds in said structure, said vehicle comprising:

housing means adapted to be secured to a tether cable;

remotely-actuatable power-actuated thruster means carried by said housing means for propelling said housing means in any direction;

remotely-actuatable television camera means carried by said housing means for viewing at the surface the illuminated water area near the housing means;

light means carried by said housing means for illuminating the area adjacent said television camera means;

buoyancy means carried by said housing means for maintaining said housing means at a buoyancy of no less than neutral buoyancy;

remotely-actuatable vehicle anchoring means mounted on said housing means for anchoring said housing means to an underwater structure;

remotely-actuatable flexible, pivotable, articulated arm means having one end of said arm means affixed to and carried by said housing means, said arm means being on the same side of said housing means as that carrying said television camera means;

said articulated arm means being elongated and having a plurality of interconnected short rigid arm segments, with the outermost segment being the terminal segment;

remotely-actuatable metal-cleaning apparatus carried by the terminal arm segment of the arm means to form cleaning arm means for cleaning a selected portion of an underwater steel structure;

remotely-actuatable camera means carried by the arm means to form viewing arm means for viewing at short range and within the range of the cleaning arm means an area of interest on said underwater steel structure;

said camera means carried by said arm means comprising a stereoscopic camera and a photoflash unit; and a remotely-operable telescoping prod extending outwardly from the camera to the object being photographed.

2. Apparatus adapted to be used with a remotely-controlled underwater vehicle operating on a tether cable from a remote location to clean, view and photograph selected area of an underwater structure, said apparatus comprising:

a tool body adapted to be secured and operatively connected to the lower portion of said underwater vehicle;

remotely-actuatable anchoring means operatively carried by said tool body;

a remotely-actuatable, flexible, pivotable, articulated cleaning arm extending from said tool body;

a cavitation jetting tool carried at the extended end of said cleaning arm;

a remotely-actuatable, flexible, pivotable, articulated viewing arm independent of said cleaning arm and extending from said tool body;

remotely-actuatable television camera means and its associated light means carried at the end of said viewing arm; and remotely-actuatable photographic camera means and its associated light means carried at the end of said viewing arm adjacent to said television camera means.

3. The apparatus of claim 2 wherein the photographic camera means is a stereoscopic camera and the light means therefor and operatively connected thereto and operable therewith is a strobe light source.

4. The apparatus for claim 2 including hose means in communication between said cavitation jetting tool and a source of pressure fluid.

* * * * *